United States Patent [19]

Berkes et al.

[11] Patent Number: 4,788,123

[45] **Date of Patent: * Nov. 29, 1988**

[54] PROCESS FOR MINIMIZING IMAGE DE-ENHANCEMENT IN FLASH FUSING SYSTEMS

[75] Inventors: John S. Berkes, Webster; Stanley B. Swackhamer, Pittsford, both of N.Y.

[73] Assignee: Xerox Corporation, Stamford, Conn.

[ * ] Notice: The portion of the term of this patent subsequent to Oct. 6, 2004 has been disclaimed.

[21] Appl. No.: 59,074

[22] Filed: Jun. 8, 1987

[51] Int. Cl.[4] ..... G03G 13/20; G03G 9/08

[52] U.S. Cl. ..... 430/124; 430/106.6; 430/110; 430/126

[58] Field of Search ..... 430/124, 109, 106.6, 430/126, 104

[56] References Cited

U.S. PATENT DOCUMENTS

| | | | |
|---|---|---|---|
| 2,986,521 | 5/1961 | Wielicki | 252/62.1 |
| 3,900,588 | 8/1975 | Fisher | 427/19 |
| 4,288,516 | 9/1981 | Gaudioso | 430/106.6 |
| 4,288,517 | 9/1981 | Arimatsu et al. | 430/110 |
| 4,301,228 | 11/1971 | Kori et al. | 430/122 |
| 4,318,974 | 3/1982 | Pacansky et al. | 430/109 |
| 4,533,616 | 8/1985 | Ohsaki et al. | 430/110 |
| 4,555,467 | 11/1985 | Hasegawa et al. | 430/110 |
| 4,698,290 | 10/1987 | Berkes | 430/124 |

FOREIGN PATENT DOCUMENTS

| | | |
|---|---|---|
| 51-81623 | 5/1975 | Japan . |
| 60-107036 | 6/1985 | Japan . |

*Primary Examiner*—John L. Goodrow

*Attorney, Agent, or Firm*—Judith L. Byorick

[57] ABSTRACT

A process for the fusing of xerographic images comprising: (1) creating a xerographic latent image; (2) developing the image with a toner composition comprising a mixture of toner particles and colloidal silica particles; (3) transferring the developed image to a substrate; and (4) subsequently fixing the developed image to the substrate with a flash fusing device by applying an energy pulse therefrom of from about 2 to about 5 milliseconds. The process is useful for enabling image de-enhancement when the fusing energy is applied over a period of from about 2 to about 5 milliseconds.

20 Claims, 13 Drawing Sheets

PROCESS FOR MINIMIZING IMAGE DE-ENHANCEMENT IN FLASH FUSING SYSTEMS

BACKGROUND OF THE INVENTION

The present invention is directed to a process of flash fusing xerographic images. More specifically, the present invention is directed to processes for flash fusing xerographic images with energy pulses having a duration exceeding one millisecond without resulting in image de-enhancement. Image de-enhancement occurs when in one embodiment the process is performed by means of energy pulses of two to five milliseconds in conjunction with a toner composition containing a colloidal silica powder.

Flash fusing is one of several methods available for permanently affixing toner images to substrates in the xerographic process. The process consists of the application of a rapid pulse of energy to the unfixed image, which causes the toner particles to melt and fuse to the substrate. Generally, flash fusing systems are designed to produce short flash pulses of energy of from about 0.5 to about 1 millisecond. Shorter pulses tend to produce excess surface temperature on the toner, which causes the toner to vaporize. Longer pulses result in image de-enhancement, the magnitude of which is dependent upon the fluidity of the toner. The de-enhancement observed when longer pulses are applied occurs because the flash energy is delivered to the toner so slowly that the toner material at the toner-paper interface remains in a very viscous state. This condition precludes wetting and spreading of the toner on the paper, but allows for coalescence of the toner particles. The net effect of applying a longer pulse is to allow a toner pile to remain in the coalescence stage of fusing at energies which, if applied in shorter pulses, would have driven the toner to a much higher temperature and resulted in little or no de-enchancement.

All flash fusing systems using energy pulses of one millisecond or less have one major disadvantage, the power supplies require capacitors, which add considerable cost, weight, and size to the system. A flash fusing system with circuitry designed such that power is drawn directly from a 117 volt alternating current line would eliminate the need for capacitors and would thus enable flash fusing in small copiers, that is those with, for example, speeds of 12 copies per minute. Such a system is disclosed in copending application U.S. Ser. No. 872,328, filed June 9, 1986, entitled "Electrophotographic Reproduction Machine With Document Exposure System Directly Coupled to AC Line Input", the disclosure of which is totally incorporated herein by reference. One characteristic of a flash fusing system drawing its power directly from a 117 VAC line is that it is capable of delivering flash pulses of a duration no shorter than approximately 3 to 5 milliseconds.

U.S. Pat. No. 4,698,290 the disclosure of which is totally incorporated herein by reference, teaches a process for reducing the energy required for flash fusing of electrostatographic images. More specifically, the process of the copending application, which reduces the energy required for flash fusing by providing a waxy, low viscosity layer at the toner-substrate interface during fusing, entails developing an image with a toner composition comprising resin particles, pigment particles, and wax, transferring the image to a substrate, and flash fusing the transferred image. An example of a toner composition disclosed in this application comprises 70 percent by weight of a polyester resulting from the condensation reaction of dimethylterephthalate, 1,3-butenediol, and pentaerythritol, 10 percent by weight of carbon black, and 20 percent by weight of polypropylene, to which was added 0.5 percent by weight of Aerosil R972 ®. This copending application does not, however, illustrate flash fusing processes wherein the fusing times are between 2 and 5 milliseconds.

Copending application U.S. Ser. No. 809,359, filed Dec. 16, 1985, entitled "Flash Fusing Process With Prespheroidized Toner", the disclosure of which is totally incorporated herein by reference, also discloses a process for reducing the energy required for flash fusing of electrostatographic images. The process of this application comprises the prespheroidization of the toner particles by heat spheroidization, which reduces image de-enhancement and reduces the required flash fusing energy. The application does not, however, disclose a flash fusing process wherein the fusing time is between 2 and 5 milliseconds. A specific toner composition illustrated in this copending application comprises 90 percent by weight of a polyester resulting from the reaction of 2,2-bis(4-hydroxyisopropoxy phenol) propane and fumaric acid, and 10 percent by weight of carbon black, to which was added 0.5 percent by weight of Aerosil R972 ®. According to the disclosure of this application, the aerosil functions primarily as a charging source.

Another reference, U.S. Pat. No. 3,900,588, discloses the use of silica compositions as toner additives to eliminate toner film buildup on the carrier particles, and to reduce the impaction of toner particles on the carrier. The silica compositions also function to maintain the stability of the developer's triboelectric properties, according to the teachings of this patent.

Also, toner compositions containing silica compositions are well known in the xerographic art. For example, U.S. Pat. No. 2,986,521 discloses a developer powder for use in electrostatic printing comprising particles of a low melting organic solid coated with colloidal silica. According to the teaching of this patent, the developer composition reduces image de-enhancement by improving the flow characteristics of the unfused developer powder.

In U.S. Pat. No. 4,288,517, a toner composition for electrostatic photography, which comprises a toner powder containing a base resin, a coloring agent, and a silica powder such as aerosil is illustrated. The surfaces of the toner particles are coated with the base resin of the toner powder. According to the teachings of this patent, the toner composition prevents toner-carrier deterioration from mechanical wear during multiple imaging and prevents formation of toner films on the carrier and the photoconductor. The toner composition also provides stable powder and electric characteristics, and improves the process of toner-carrier mixing.

Additionally, U.S. Pat. No. 4,301,228 discloses a developer which includes carrier particles, electrically insulative toner particles, and electrically insulative fine particles composed of a metallic oxide, such as silica. The silica particles adhere to the surfaces of both the toner particles and the carrier particles preventing toner and carrier from adhering to each other after long periods of use.

Also, U.S. Pat. No. 4,533,616 illustrates a developer composition containing a toner and a microencapsulated additive capable of gradual release into the developer during the development process. The additive may be a microcapsule particle with a core of colloidal silica and a wall of a high polymer surrounding the core. This developer composition has high stability, high durability, good charging characteristics, and improved flow characteristics of the dry powder.

Furthermore, U.S. Pat. No. 4,555,467 discloses a one-component developer comprising toner particles and flow-improving granules composed of a coloidal silica. The developer has high durability and fixability, stores well, does not adhere to photoreceptor surfaces, and has good flow characteristics as a dry powder.

Japanese Patent Publication No. 51-81623 discloses a negatively charged toner consisting of small amounts of silica dispersed in a resin. The toner is characterized by a negative polarity when in contact with a carrier, and a lack of adhesion between individual particles. The toner provides images of uniform density and does not adhere to the developing apparatus. A similar toner is disclosed in Japanese Patent Publication No. 60-107036, said toner containing a binding resin and a fine silica powder which is mixed with the resin, and has good fluidity even though it contains a small amount of silica powder.

Although the above documents disclose toner compositions suitable for their intended purposes, they do not illustrate a process for the flash fusing of images that avoids image de-enhancement when energy pulses greater than one millisecond are used. In the above references, the addition of a silica composition improves the flow characteristics of the dry toner powder or functions as a charging source; none of these references, however, refer to the problem of image de-enhancement during flash fusing processes using energy pulses of 2 to 5 milliseconds.

SUMMARY OF THE INVENTION

Figure 1:
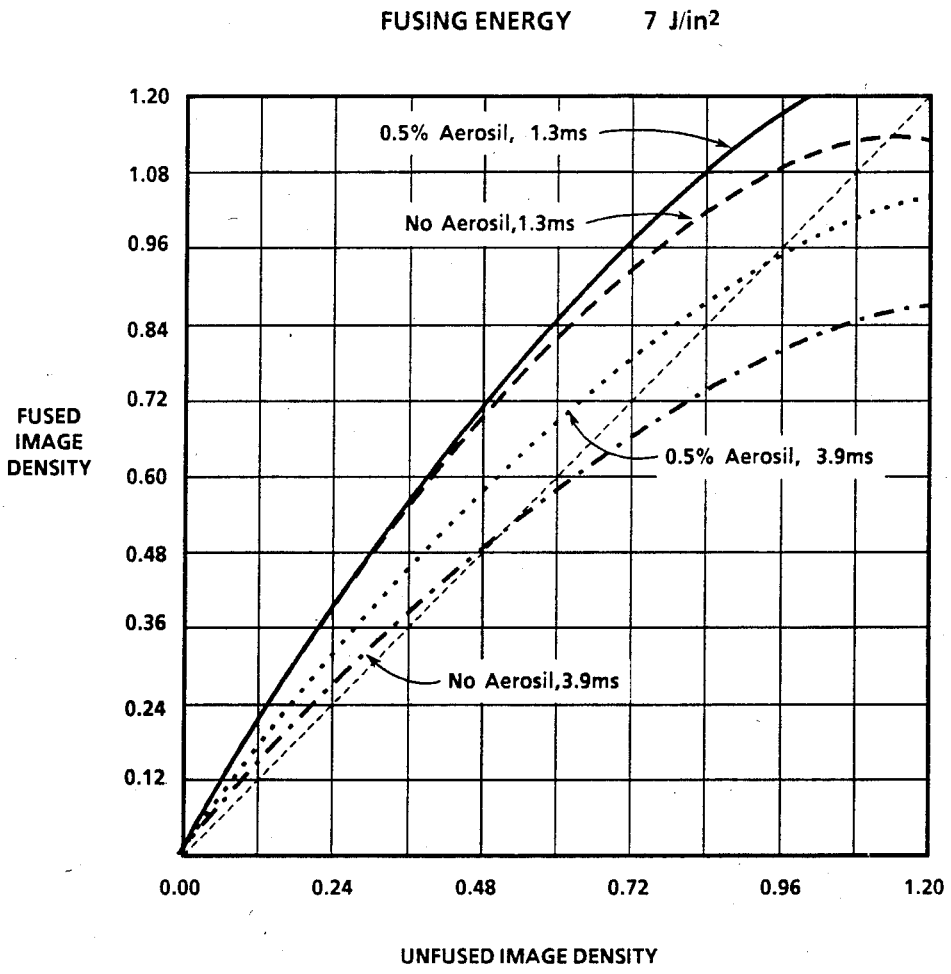
FIGS. 1 to 12 illustrate the amount of image de-enhancement obtained with the processes of the present invention under various conditions. Details concerning the data illustrated in these Figures are contained herein in the working Examples.

It is an object of the present invention to provide a process for the flash fusing of xerographic images.

It is another object of the present invention to provide a flash fusing process that uses energy pulses of 2 to 5 milliseconds without resulting in image de-enhancement.

It is yet another object of the present invention to provide a flash fusing process compatible with a flash fusing system having circuitry designed such that power is provided directly from a 117 volt alternating current line.

These and other objects of the present invention are achieved by providing a flash fusing process that prevents toner particles from coalescing when energy is delivered to the toner piles relatively slowly, in pulses of 2 to 5 milliseconds. In one embodiment of the invention, the process comprises: (1) creating a xerographic latent image: (2) developing the image with a toner composition comprising a mixture of toner particles and added colloidal silica particles; (3) transferring the developed image to a substrate; and (4) subsequently fixing the developing image to the substrate with a flash fusing device by applying an energy pulse therefrom of from about 2 to about 5 milliseconds. One specific embodiments of the invention comprises: (1) creating a xerographic latent image; (2) developing the image with a toner composition comprising a mixture of added colloidal silica particles and toner particles, which toner particles include a polymeric wax having a weight average molecular weight of from about 1,000 to about 20,000; (3) transferring the developed image to a substrate; and (4) subsequently fixing the developed image to the substrate with a flash fusing device by applying an energy pulse therefrom of from about 2 to about 5 milliseconds.

Various xerographic imaging devices suitable for the present invention may be of any kind suitable for use with a flash fusing system, examples of which include the Xerox 1025®, Xerox 4045®, and the like, available from Xerox Corporation. The choice of imaging device is limited only by the flash rate within the machine, which must be between about 2 and about 5 milliseconds.

Various toner resins are suitable for the present invention. Toner resins of relatively low viscosity, however, such as polyesters and resins having viscosities in the range of approximately $10^3$ poise at 130° C., are preferred because the developed image may be affixed to the substrate with a minimum of energy input. Propoxylated bisphenol fumarate, prepared by the reaction of bisphenol A and propylene oxide with fumaric acid, is a preferred polyester resin. Illustrative examples of toner resins that are also believed to be suitable for the present invention include polyamides, epoxies, polyurethanes, diolefins, vinyl resins and polymeric esterification products of a dicarboxylic acid and a diol comprising a diphenol. Typical vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxyklic acids, including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes, especially those available as Pliolites; and mixtures of these monomers. The resins are generally present in an amount of from about 30 to about 99 percent by weight of the toner composition.

Suitable pigments or dyes selected as colorants for the toner particles include carbon black, nigrosine dye, aniline blue, magnetites and mixtures thereof, with carbon black being the preferred colorant. The pigment should be present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, less or greater amounts of pigment particles may be present provided that the objectives of the present invention are achieved.

When the pigment particles are magnetites, which comprise a mixture of iron oxides ($Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight.

Colored toner pigments are also suitable for use with the present invention, including red, green, blue, brown, magenta, cyan, and yellow particles, as well as mixtures thereof. Illustrative examples of suitable magenta pigments include 2,9-dimethyl-substituted quinacridone and anthraquinone dye, identified in the color index as Cl 60710, Cl Dispersed Red 15, a diazo dye identified in the color index as Cl 26050, Cl Solvent Red 19, and the like. Illustrative examples of suitable cyan pigments include copper tetra-4-(octadecyl sulfonamido) phthalocyanine, X-copper phthalocyanine pigment, listed in the color index as Cl 74160, Cl Pigment Blue, and Anthradanthrene Blue, identified in the color index as Cl 69810, Special Blue X-2137, and the like. Illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. These color pigments are generally present in an amount of from about 5 weight percent to about 20 weight percent based on the weight of the toner resin particles, although lesser or greater amounts may be present provided that the objectives of the present invention are met.

Colloidal silica external additive powders selected for the invention generally possess a small particle size of about 70 to about 300 Angstroms, and preferably approximately 150 Angstroms, such as Aerosil R972®, available from Degussa, Inc. The dry colloidal silica particles are present in an amount of from about 0.2 present to 1 percent by weight, and preferably about 0.5 percent by weight of the toner particles.

With respect to the optional wax component of the toner particles, suitable waxes are polymeric materials having a weight average molecular weight of from about 1,000 to about 20,000, and preferably of less than 6,000, such as polyethylenes and polypropylenes commercially available from Petrolite Corporation and from Sanyo Corporation as Viscol 550-P. The presence of polypropylene in the toner composition has been observed to minimize image de-enhancement further. Although it is not desired to be limited by theory, it is believed that the polypropylene creates a low viscosity interface between the toner and the paper, which enhances spreading of the toner. The polypropylene component may be present in an amount of from about 2 to about 20 percent by weight, and preferably in an amount of approximately 20 percent by weight of the toner composition.

The toner composition may be selected as a single component developer, or it may be admixed with carrier particles. When a carrier is selected, it should preferably be magnetic in character, such as steel, nickel, or iron ferrites. Illustrative examples of carrier particles suitable for the present invention include granular zircon, steel, nickel, iron ferrites, and the like. Other suitable carrier particles include nickel berry carriers as disclosed in U.S. Pat. No. 3,847,604, the disclosure of which is totally incorporated herein by reference. These carriers comprise nodular carrier beads of nickel characterized by surfaces of reoccurring recesses and protrusions that provide the particles with a relatively large external area. The diameters of the carrier particles may vary, but are generally from about 50 microns to about 1,000 microns, thus allowing the particles to possess sufficient density and inertia to avoid adherence to the electrostatic images during the development process.

Carrier particles selected for the invention may contain a coating thereover. Coating materials include polymers and terpolymers, including fluoropolymers such as polyvinylidene fluorides, reference U.S. Pat. Nos. 3,526,533; 3,849,186; and 3,942,979, the disclosures of which are totally incorporated herein by reference. Preferred carriers are steel, coated steel, iron ferrites, and coated iron ferrites. The toner may be present in an amount equal to 1 to 3 percent by weight of the carrier, and preferably is equal to 3 percent by weight of the carrier.

The toner compositions selected are prepared by mixing the dry toner particles, which comprise resin particles, pigment particles, and an optional polymeric wax component with dry colloidal silica particles. In one suitable mixing process a ball mill is selected. Steel beads for agitation are added in an amount of approximately five times the weight of the combined toner and silica powders. The ball mill is operated at about 120 feet per minute for about 30 minutes after which the steel beads are removed. Other similar blending methods may also be used. The resulting toner composition is then admixed with carrier particles such that the toner is present in an amount of 1 to 3 percent by weight of the carrier, and preferably 3 percent by weight of the carrier.

Development may be accomplished by a number of methods, such as magnetic brush, cascade, powder cloud, and the like. Transfer of the developed image to a substrate may be by any method, including those wherein a corotron is selected, or a biased roll is utilized. Any paper or transparency material used in xerographic copiers and printers may be used as a substrate.

The flash fusing device selected may be of any type that allows the energy pulses to be delivered in periods of 2 to 5 milliseconds, and may include components such as a xenon flash lamp. Systems operated by capacitors may be used provided that they are capable of delivering energy pulses of the duration required. Preferred devices include direct line coupled flash fusing systems such as the one disclosed in copending application U.S. Ser. No. 872,328, mentioned herein.

Figure 13:
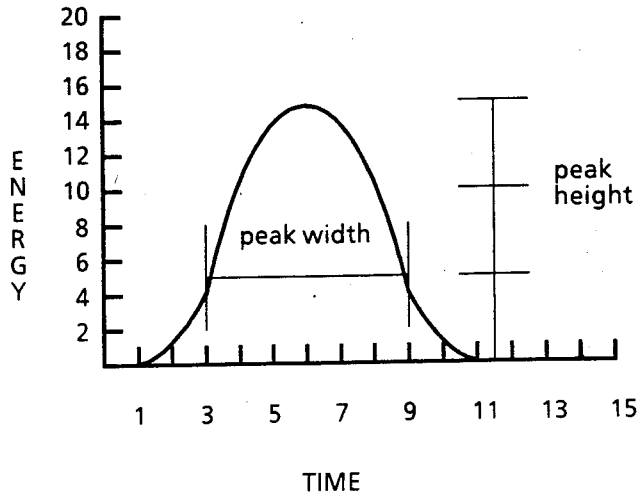
FIG. 13 represents an energy verses time curve illustrating how peak width is calculated.

Energy flashes applied from the fusing device may possess magnitudes of from about 4 to about 8 joules per square inch with the preferred values being from about 5 to about 7.8 joules per square inch. The flashes may range from about 2 to about 5 milliseconds with the preferred values being from about 3.3 to about 4.3 milliseconds. Duration of the flash is measured in terms of "peak width" as illustrated herein. More specifically, the energy applied is plotted against time, and the width of the resulting curve is measured between the two sides corresponding to one third of its height, which distance is defined as peak width. The time durations of energy flashes referred to herein are all measured in terms of peak width. FIG. 13 illustrates an energy verses time curve indicating how peak width is calculated. The time and energy are arbitrary.

Image de-enhancement may be determined by comparing the optical density of the unfused image to that of the fused image. Optical density measures the "blackness" or darkness of the image. If the fused image possess less optical density than the unfused image, image de-enhancement has occured during the fusing process. When the fused image possesses the same or greater optical density than the unfused image, image de-enhancement has not occurred. Optical density may be measured with an optical densitometer such as the Macbeth Densitometer, Model RD 915.

Although it is not desired to be limited by theory, it is believed that the presence of a colloidal silica powder in the toner composition minimizes coalescence and agglomeration of the toner particles, thus maintaining a toner layer of uniform thickness. To maintain uniform thickness of a toner pile, one must prevent the particles from wetting each other and agglomerating. Uniformity of the toner pile optimizes absorption of energy, which results in reduced image de-enhancement. When relatively short flashes of energy are applied, namely those in the range of about 0.5 to about 1 millisecond, the coalescence phase is short and the toner rapidly fuses into the substrate. Thus, the presence of colloidal silica powder in the toner composition has either no effect or a slightly detrimental effect on the fusing process at those flash durations. When flashes of energy lasting more than about 5 milliseconds are applied, most of the energy is transferred to the substrate, and no fusing occurs regardless of whether or not a colloidal silica powder is present in the toner composition. However, when flashes of energy of from about 2 to about 5 milliseconds are applied, the presence of colloidal silica powder in the toner composition significantly reduces image de-enhancement.

The following examples are illustrative in nature and are not intended to limit the scope of the invention. Other embodiments may occur to those skilled in the art. Parts and percentages are by weight unless otherwise indicated.

EXAMPLE I

Xerographic images of solid area density patches were formed and developed in a Xerox 3100® copier with a toner composition comprising 90 percent by weight of a polyester (propoxylated bisphenol fumarate), and 10 percent by weight carbon black to which was added Aerosil R972® silica powder as an external additive in an amount equal to 0.5 percent by weight of the toner composition. The images were developed and transferred by a corotron to Xerox 4024 DP® paper. Additional images were then generated by the same method with a toner composition identical to the one described but containing no colloidal silica, and the results are illustrated in FIG. 1 that follows. After development and transfer, the images were affixed to the Xerox 4024 DP® paper by flash fusing.

The flash device was of the type that permits peak width and fusing energy to be mutually independent. The system was calibrated for 1.3 and 3.9 millisecond (ms) peak widths. Peak shapes were established by an oscilloscope, and the widths were then measured at one-third peak height. Fusing energy was maintained constant at 7 joules per square inch (J/in$^2$). Before and after fusing, optical density was measured with a Macbeth Densitometer Model RD 915. At relatively short peak pulses of 1.3 milliseconds, the presence of the colloidal silica had a minimal effect at low unfused image densities of between 0 and about 0.36 optical density units. At high unfused image densities of between about 0.48 and 1.20 optical density units, the presence of colloidal silica reduced de-enhancement. At relatively long peak pulses of 3.9 milliseconds, the presence of colloidal silica reduced image de-enhancement across the entire image density spectrum of 0 to 1.20 optical density units, and was particularly effective at higher image densities.

FIG. 1 represents a plot of fused image density versus unfused image density for the images formed as described in this Example. A second order polynomial ($Y=A+Bx+Cx^2$) was fitted to the data points by the method of least squares. The polynomial has no physical meaning; its only purpose is to assist in the perception of the differences between the data sets presented. A diagonal straight line at a 45 degree angle is provided for reference purposes and represents the points at which unfused image density is identical to fused image density. Points which fall below this line indicate image de-enhancement; points above or on the line indicate an absence of image de-enhancement.

EXAMPLE II

Figure 2:
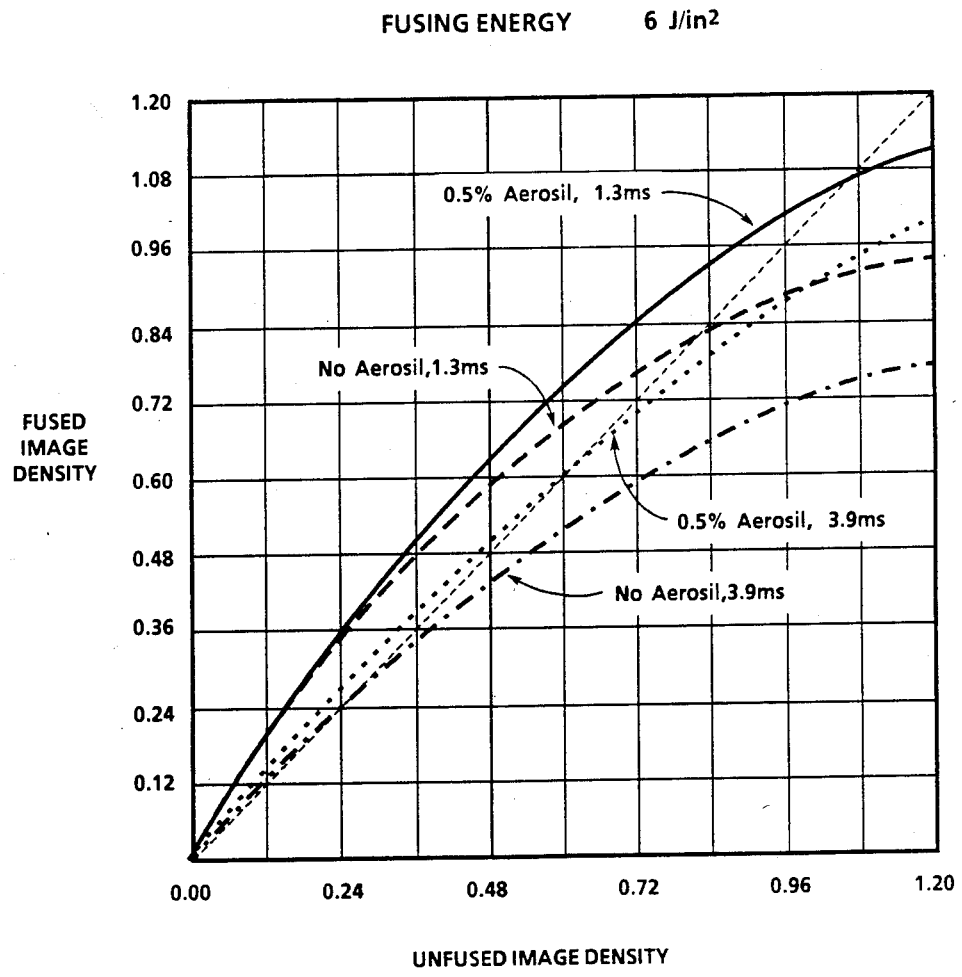

The procedures of Example I were repeated with the exception that the fusing energy was maintained constant at 6 joules/in$^2$. As observed in Example I, at relatively short peak pulses of 1.3 milliseconds, the presence of the colloidal silica had a minimal effect at low unfused image densities of between 0 and about 0.36 optical density units; at high unfused image densities of between about 0.48 and 1.20 optical density units, the presence of colloidal silica reduced de-enhancement. At relatively long peak pulses of 3.9 milliseconds, the presence of colloidal silica reduced image de-enhancement across the entire image density spectrum of 0 to 1.20 optical density units, and was particularly effective at higher image densities. FIG. 2, which was prepared by the method described for FIG. 1, represents a plot of the quantitative results for this Example.

EXAMPLE III

Figure 3:
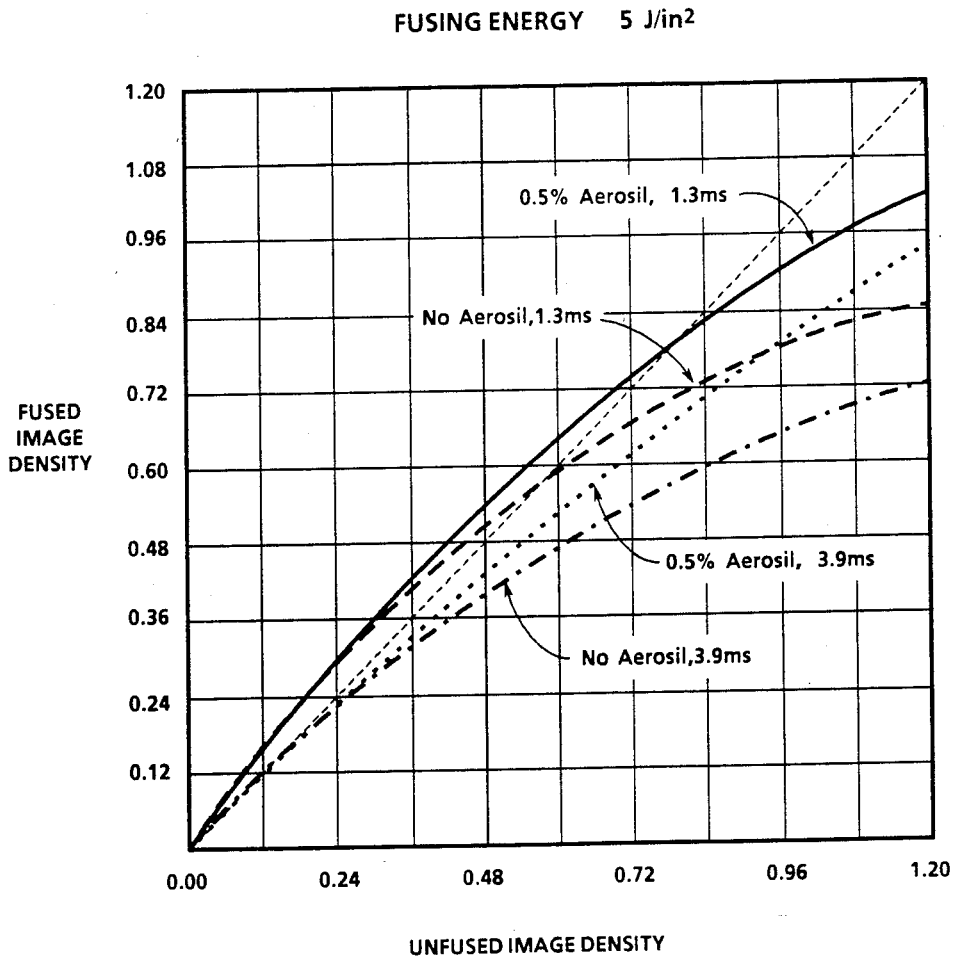

The procedures of Example I were repeated with the exception that the fusing energy was maintained constant at 5 joules/in$^2$. As observed in the preceding Examples, at relatively short peak pulses of 1.3 milliseconds, the presence of the colloidal silica had a minimal effect at low unfused image densities of between 0 and about 0.36 optical density units at high unfused image densities of between about 0.48 and 1.20 optical density units, the presence of colloidal silica reduced de-enhancement. At relatively long peak pulses of 3.9 milliseconds, the presence of colloidal silica reduced de-enhancement across the entire image density spectrum of 0 to 1.20 optical density units, and was particularly effective at higher image densities. FIG. 3 represents a plot of the quantitative results for this Example.

EXAMPLE IV

Figure 4:
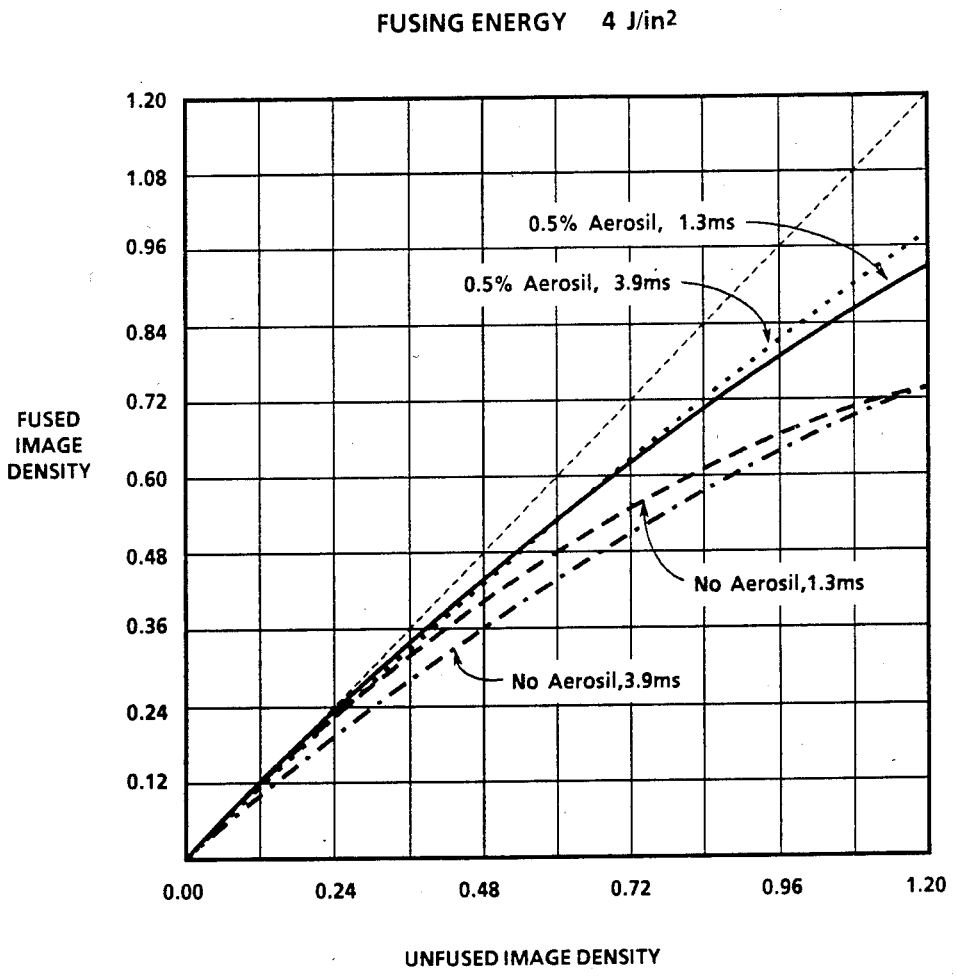

The procedures of Example I were repeated with the exception that the fusing energy was maintained constant at 4 joules/in$^2$. At this energy, the differences between the images prepared from the toner composition containing colloidal silica and those prepared from the toner composition without colloidal silica continues to be evident. However, at this low energy the differences in the density curves are not due to peak width alone; images prepared from the toner containing colloidal silica underwent less image de-enhancement than the images prepared from the toner containing no colloidal silica, regardless of peak width. FIG. 4 represents a plot of the quantitative results for this Example.

EXAMPLE V

Figure 5:
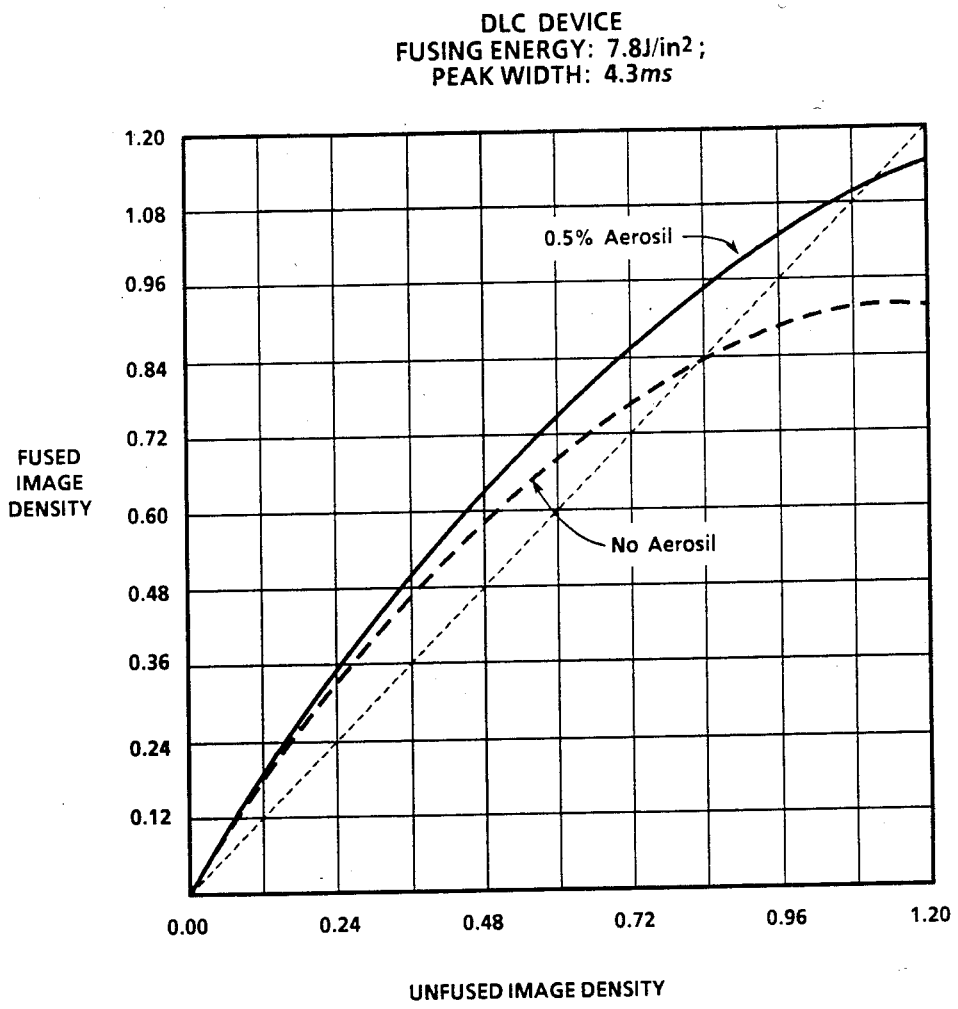

The procedures of Example I were repeated with the exception that a direct line coupled flash fusing system wherein peak width and fusing energy are not mutually independent was used to affix the developed images to the paper. Fusing energy was maintained constant at 7.8 joules/in$^2$, and the peak width was 4.3 milliseconds. The presence of colloidal silica was observed to reduce image de-enhancement across the entire image density spectrum of 0 to 1.20 optical density units. FIG. 5 represents a plot of the quantitative results for this Example.

EXAMPLE VI

Figure 6:
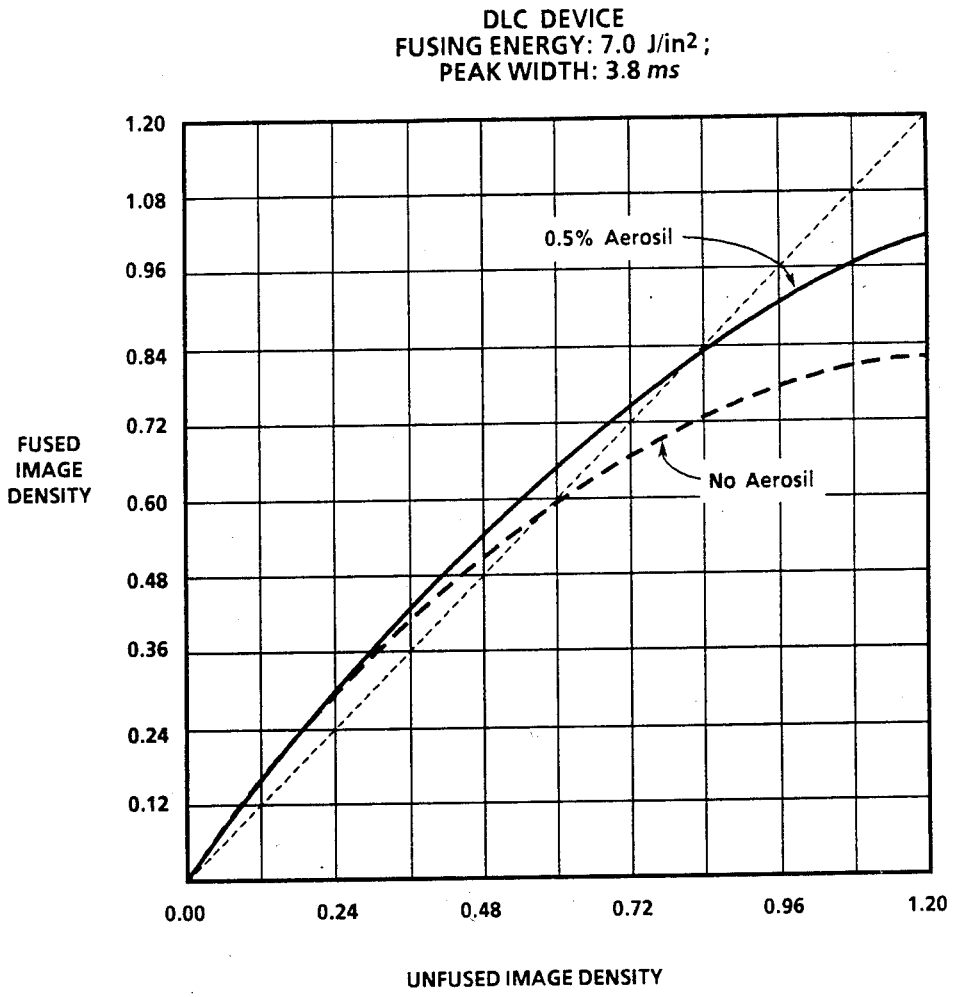

The procedures of Example V were repeated with the exception that the fusing energy was maintained constant at 7.0 joules/in$^2$, and the peak width was 3.7 milliseconds. The presence of colloidal silica was observed to reduce image de-enhancement across the entire image density spectrum of 0 to 1.20 optical density units. FIG. 6 represents a plot of the quantitative results for this Example.

EXAMPLE VII

Figure 7:
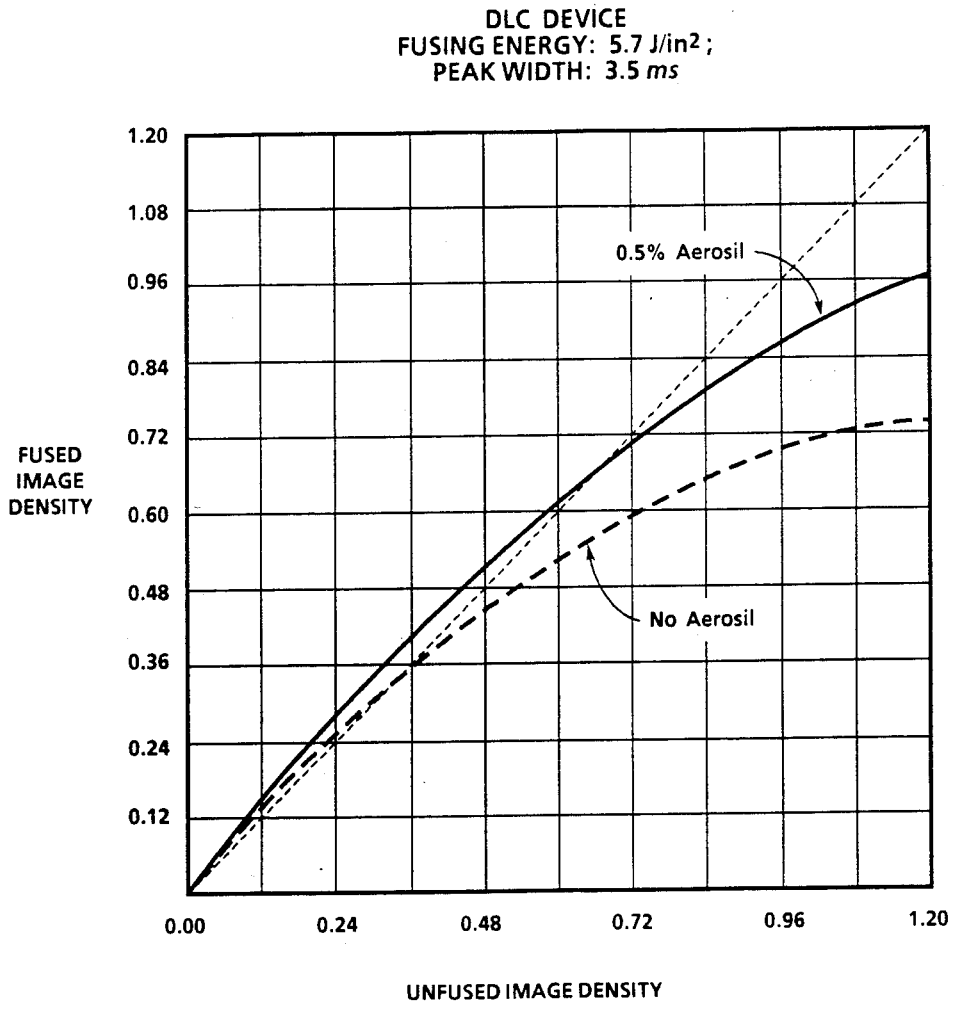

The procedures of Example V were repeated with the exception that the fusing energy was maintained constant at 5.7 joules/in$^2$, and the peak width was 3.5 milliseconds. The presence of colloidal silica was observed to reduce image de-enhancement across the entire image density spectrum of 0 to 1.20 optical density units. FIG. 7 represents a plot of the quantitative results for this Example.

EXAMPLE VIII

Figure 8:
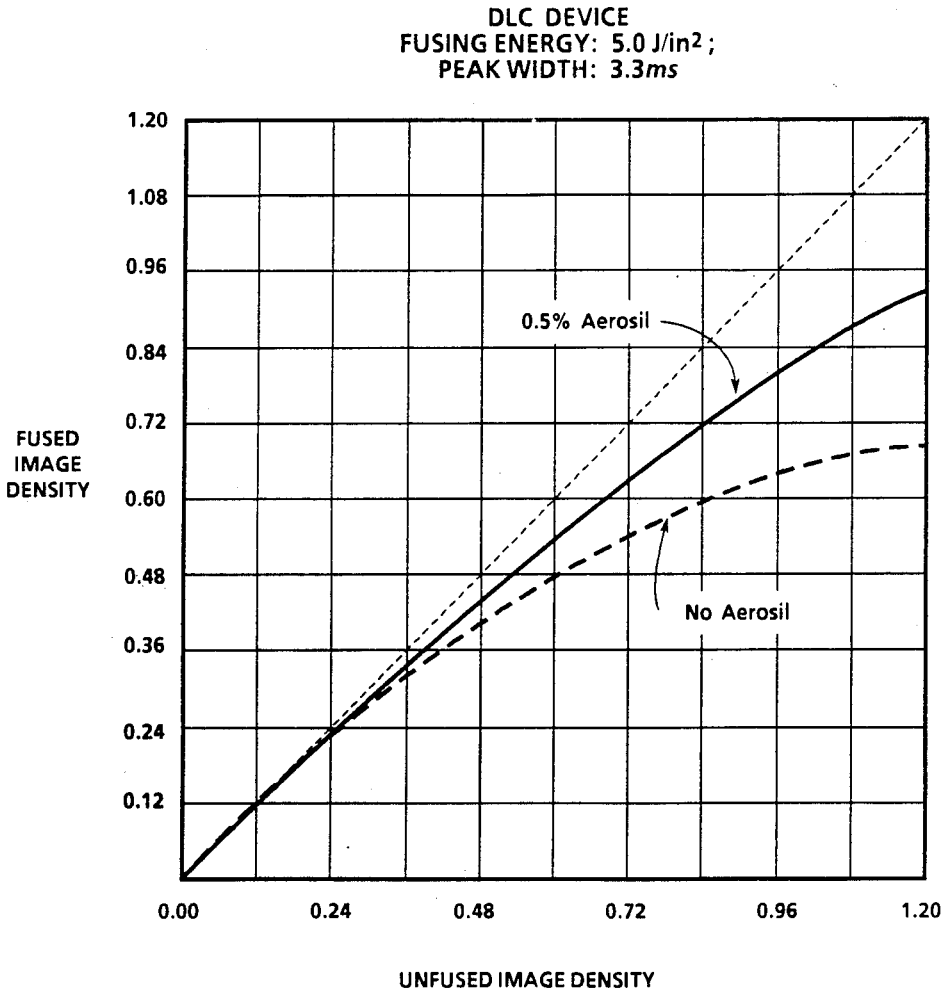

The procedures of Example V were repeated with the exception that the fusing energy was maintained constant at 5.0 joules/in$^2$, and the peak width was 3.3 milliseconds. The presence of colloidal silica was observed to reduce de-enhancement across the entire image density spectrum of 0 to 1.20 optical density units. FIG. 8 represents a plot of the quantitative results for this Example.

EXAMPLE IX

Figure 9:
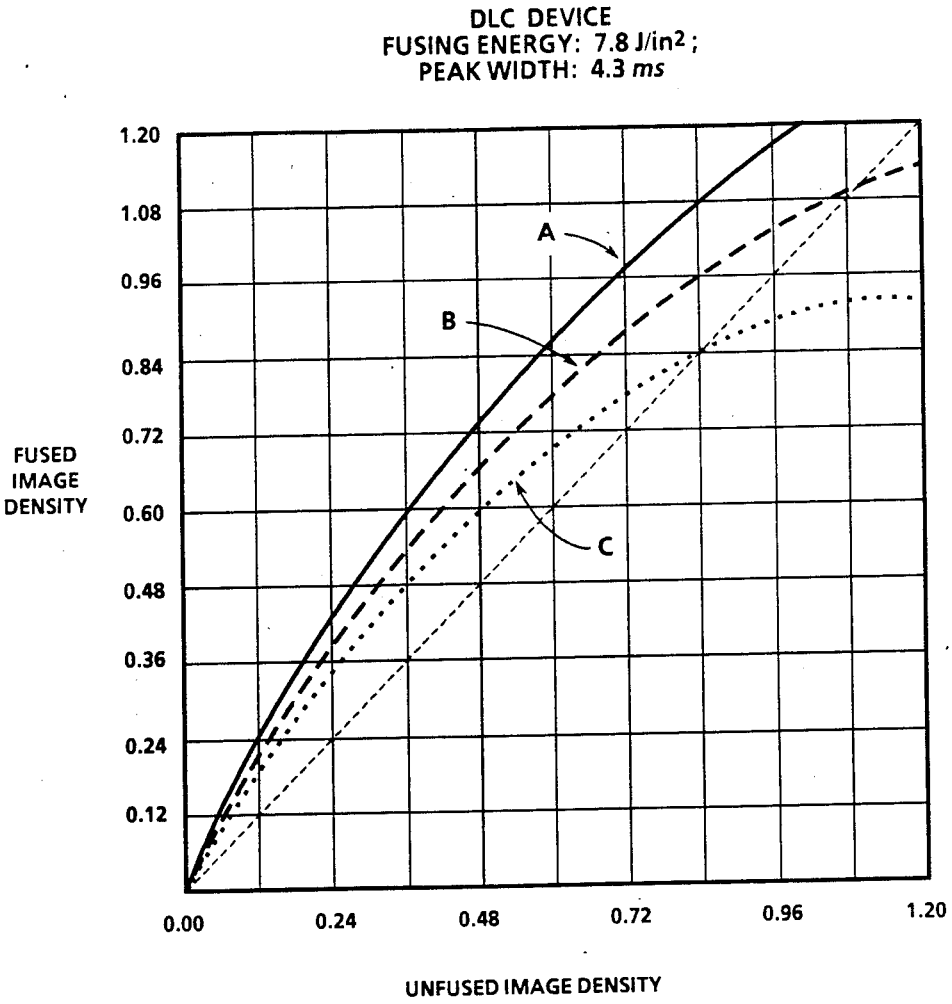

The procedures of Example V were repeated. In addition, a third toner composition comprising about 70 percent by weight polyester, about 20 percent by weight of a polypropylene wax commercially available at Viscol 550-P from Sanyo Corporation, and about 10 percent by weight carbon black was prepared, and to this composition was added a colloidal silica powder as an external additive in an amount of about 0.5 percent by weight of the toner. The presence of polypropylene was found to cause additional minimization of the image de-enhancement across the entire image density spectrum of 0 to 1.20 optical density units. FIG. 9 represents a plot of the quantitative results for this Example. Line A represents results obtained with the toner composition comprising 70 percent polyester, 20 percent polypropylene, and 10 percent carbon black, to which was added 0.5 percent Aerosil R972 ® colloidal silica. Line B represents results obtained with the toner composition comprising 90 percent polyester, and 10 percent carbon black, to which was added 0.5 percent Aerosil R972 ®. Line C represents results obtained with the toner composition comprising 90 percent polyester and 10 percent carbon black with no colloidal silica added.

EXAMPLE X

Figure 10:
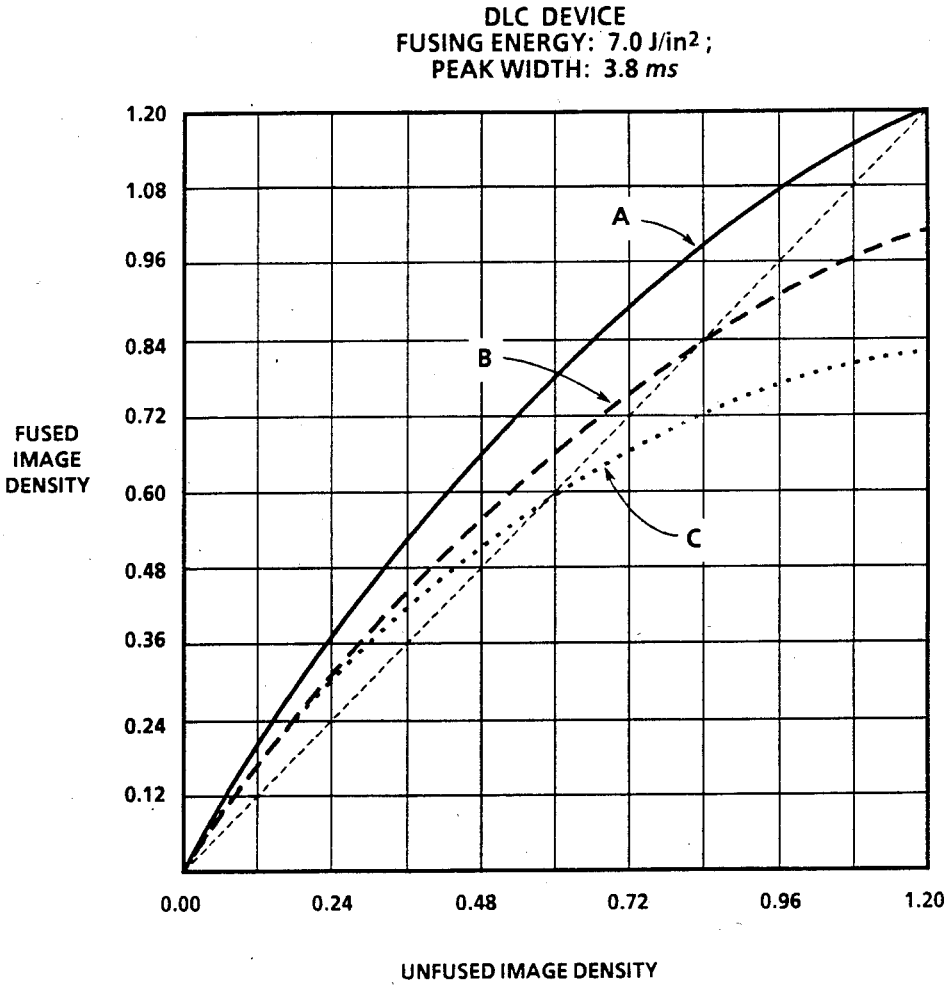

The procedures of Example VI were repeated. In addition, a third toner composition comprising about 70 percent by weight polyester, about 20 percent by weight of a polypropylene wax commercially available from Sanyo Corporation as Viscol 550-P, and about 10 percent by weight carbon black was prepared, and to this composition was added colloidal silica as an external additive in an amount of about 0.5 percent by weight of the toner. The presence of polypropylene was found to cause additional minimization of the image de-enhancement across the entire image density spectrum of 0 to 1.20 optical density units. FIG. 10 represents a plot of the quantitative results for this Example. Line A represents results obtained with the toner composition comprising 70 percent polyester, 20 percent polypropylene, and 10 percent carbon black, to which was added 0.5 percent Aerosil R972 ® colloidal silica. Line B represents results obtained with the toner composition comprising 90 percent polyester, and 10 percent carbon black, to which was added 0.5 percent Aerosil R972 ®. Line C represents results obtained with the toner composition comprising 90 percent polyester and 10 percent carbon black with no colloidal silica added.

EXAMPLE XI

Figure 11:
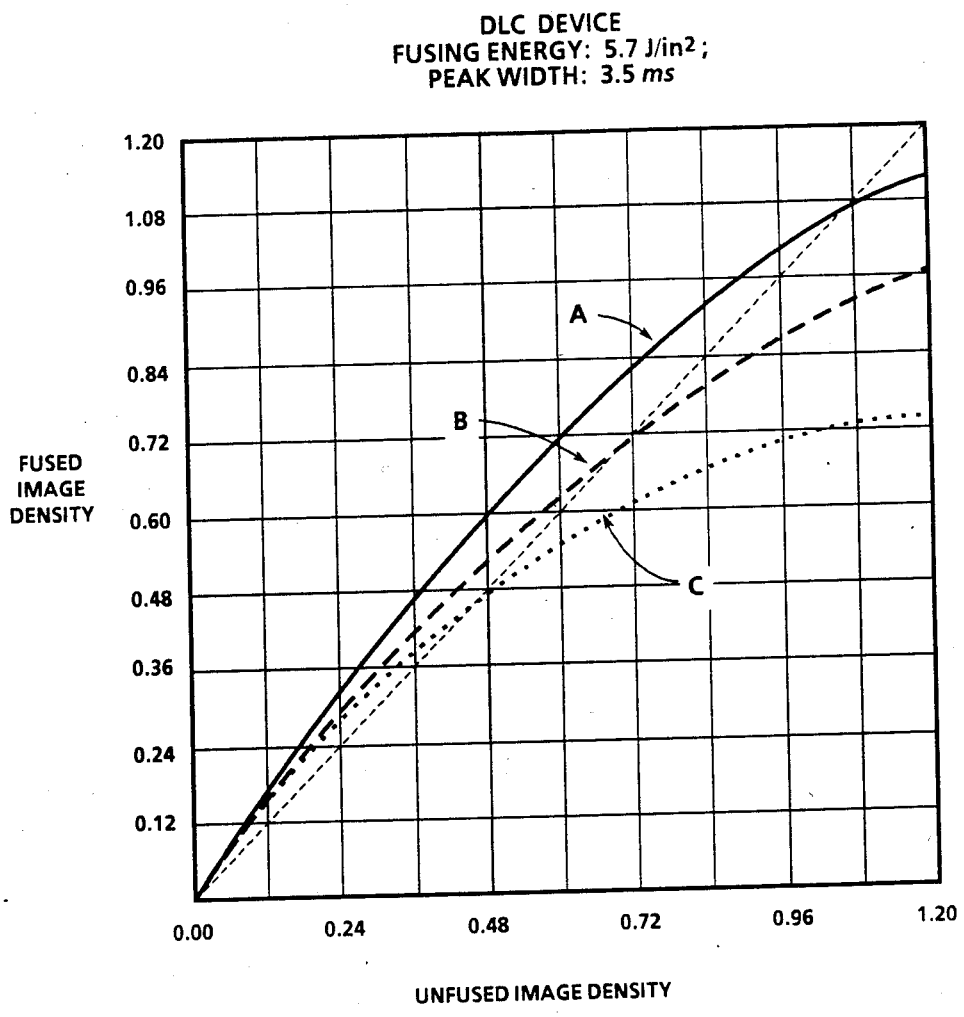

The procedures of Example VII were repeated. In addition, a third toner composition comprising about 70 percent by weight polyester, about 20 percent by weight of a polypropylene wax commerically available from Sanyo Corporation as Viscol 550-P, and about 10 percent by weight carbon black was also prepared, and to this composition was added colloidal silica as an external additive in an amount of about 0.5 percent by weight of the toner. The presence of polypropylene was found to cause additional minimization of the image de-enhancement across the entire image density spectrum of 0 to 1.20 optical density units. FIG. 11 represents a plot of the quantitative results for this Example. Line A represents results obtained with the toner composition comprising 70 percent polyester, 20 percent polypropylene, and 10 percent carbon black, to which was added 0.5 percent R972 colloidal silica. Line B represents results obtained with the toner composition comprising 90 percent polyester, and 10 percent carbon black, to which was added 0.5 percent Aerosil R972 ®. Line C represents results obtained with the toner composition comprising 90 percent polyester and 10 percent carbon black with no colloidal silica added.

EXAMPLE XII

Figure 12:
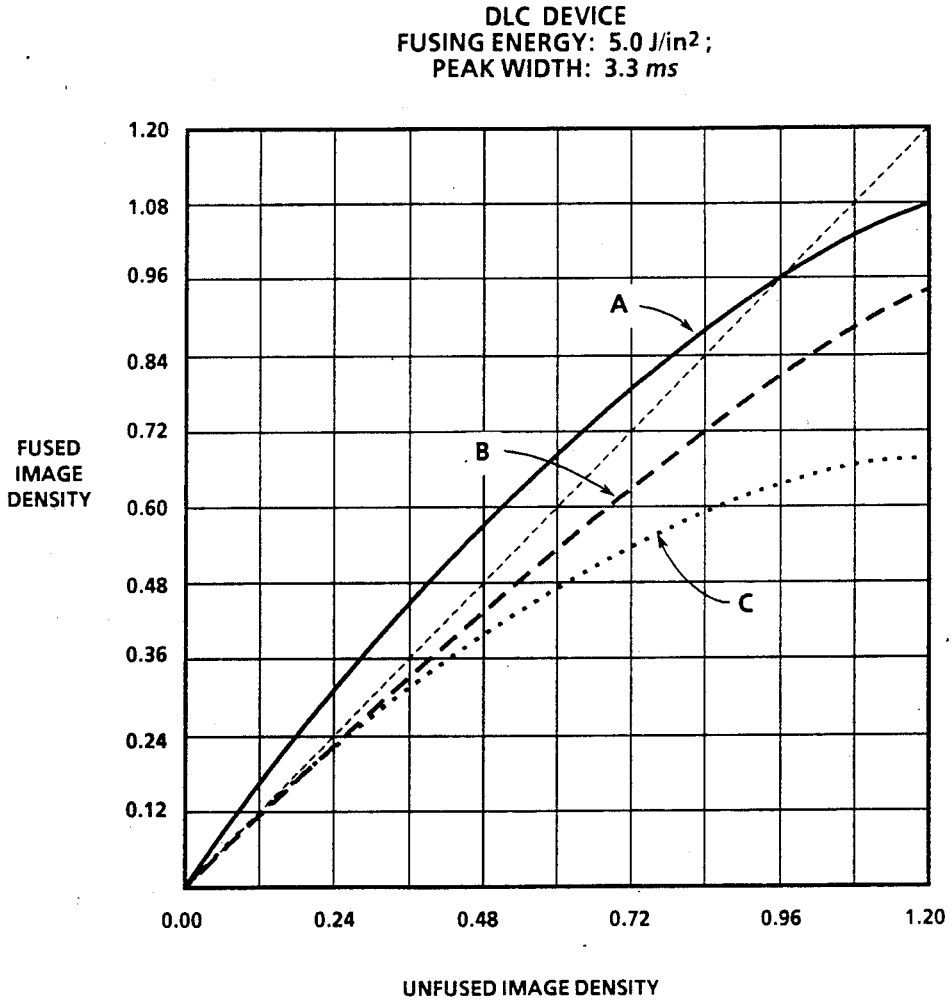

The procedures of Example VIII were repeated. In addition, a third toner composition comprising about 70 percent by weight polyester, about 20 percent by weight polypropylene wax commercially available from Sanyo Corporation as Viscol 550-P, and about 10 percent by weight carbon black was prepared, and to this composition was added colloidal silica as an external additive in an amount of about 0.5 percent by weight of the toner. The presence of polypropylene was found to cause additional minimization of the image de-enhancement across the entire image density spectrum of 0 to 1.20 optical density units. FIG. 12 represents a plot of the quantitative results for this Example. Line A represents results obtained with the toner composition comprising 70 percent polyester, 20 percent polypropylene, and 10 percent carbon black, to which was added 0.5 percent Aerosil R972 ® colloidal silica. Line B represents results obtained with the toner composition comprising 90 percent polyester, and 10 percent carbon black, to which was added 0.5 percent Aerosil R972 ®. Line C represents results obtained with the toner composition comprising 90 percent polyester and 10 percent carbon black with no colloidal silica added.

The results in Examples I to XII demonstrate that the presence of colloidal silica minimizes de-enhancement when wide peak widths are used, and that the de-enhancement occurs independently of the flash fusing energy used, provided that the energy is between 4 and 7 Joule/in$^2$. In addition, the presence of colloidal silica minimizes de-enhancement at low energy (4 Joule/in$^2$) and narrow peak widths. It appears that the presence of colloidal silica retards coalescence during the initial stage of fusing, which leads to a more uniform toner coverage of the paper; this uniformity, in turn, results in a more efficient absorption of radiant energy. Thus, using colloidal silica powder in combination with a low viscosity toner material enables minimal de-enhancement, which is characteristic of a high viscosity polymer, and also enables a good fix at low energies, which is ordinarily possible only with a low viscosity polymer. In addition, the presence of polypropylene in the toner composition further minimizes image de-enhancement under the conditions specified.

The above examples are illustrative in nature, and the invention is not limited to the specific embodiments. Those skilled in the art will recognize variations and modifications that may be made which are within the scope of the following claims.

What is claimed is:

1. A process for the fusing of xerographic images comprising: (1) creating a xerographic latent image: (2) developing the image with a toner composition comprising a mixture of toner particles and added colloidal silica particles; (3) transferring the developed image to a substrate; and (4) subsequently fixing the developed image to the substrate with a flash fusing device by applying an energy pulse therefrom of from about 2 to about 5 milliseconds, wherein there results reduced image de-enhancement.

2. A process in accordance with claim 1 wherein the toner particles comprise resin particles and pigment particles.

3. A process in accordance with claim 2 wherein the resin particles comprise polyester.

4. A process in accordance with claim 1 wherein the toner composition is admixed with magnetic carrier particles.

5. A process in accordance with claim 4 wherein the magnetic carrier is present in an amount of from 1 to about 5 percent by weight of the toner composition.

6. A process in accordance with claim 1 wherein the toner composition also comprises a polymeric wax having a weight average molecular weight of from about 1,000 to about 20,000.

7. A process in accordance with claim 6 wherein the polymeric wax is selected from the group consisting of polyethylene and polypropylene.

8. A process in accordance with claim 1 wherein the toner composition comprises a polyester resin present in an amount of from about 30 to about 99 percent by weight, carbon black pigment particles present in an amount of from about 1 to about 20 percent by weight, and a polymeric wax having a weight average molecular weight of from about 1,000 to about 20,000 present in an amount of from 0 to about 20 percent by weight, and wherein the added colloidal silica particles are present in an amount of from about 0.2 to about 1 percent by weight.

9. A process in accordance with claim 1 wherein the toner composition comprises a polyester resin present in an amount of about 90 percent by weight and carbon black pigment particles present in an amount of about 10 percent by weight, and wherein the added colloidal silica particles are present in an amount of about 0.5 percent by weight of the toner.

10. A process in accordance with claim 1 wherein the toner composition comprises a polyester resin present in an amount of about 70 percent by weight, carbon black present in an amount of about 10 percent by weight, and a polypropylene wax having a weight average molecular weight of from about 1,000 to about 6,000 present in an amount of about 20 percent by weight, and wherein the added colloidal silica particles are present in an amount of about 0.5 percent by weight of the toner.

11. A process in accordance with claim 1 wherein the flash fusing device possesses circuitry that enables power to be obtained directly from a 117 volt alternating current line.

12. A process in accordance with claim 1 wherein the flash fusing device is operated by capacitors.

13. A process in accordance with claim 1 wherein the energy pulse that fuses the image to the substrate is applied for a period of between about 2 and about 5 milliseconds.

14. A process in accordance with claim 1 wherein the energy pulse that fuses the image to the substrate is applied for a period of between about 3.3 and about 4.3 milliseconds.

15. A process in accordance with claim 1 wherein the energy applied has a magnitude of from about 4 to about 8 joules per square inch.

16. A process in accordance with claim 1 wherein the energy applied has a magnitude of from about 5 to about 7.8 joules per square inch.

17. A process in accordance with claim 1 wherein the substrate to which the image is transferred comprises paper.

18. A process in accordance with claim 1 wherein the substrate to which the image is transferred comprises transparency material.

19. A process in accordance with claim 1 wherein the developed image is transferred to the substrate by means of a corotron.

20. A process in accordance with claim 1 wherein the developed image is transferred to the substrate by means of a bias transfer roll.

* * * * *